US005985087A

United States Patent [19]

Karl et al.

[11] Patent Number: 5,985,087

[45] Date of Patent: Nov. 16, 1999

[54] INSULATOR WITH CEMENT COMPOUND AND METHOD FOR ITS PRODUCTION

[75] Inventors: Thomas Karl, Wunsiedel; Martin Kuhl, Selb, both of Germany

[73] Assignee: CeramTec AG Innovative Ceramic Engineering, Plochingen, Germany

[21] Appl. No.: 08/875,691

[22] PCT Filed: Jan. 19, 1996

[86] PCT No.: PCT/EP96/00226

§ 371 Date: Aug. 27, 1997

§ 102(e) Date: Aug. 27, 1997

[87] PCT Pub. No.: WO96/24144

PCT Pub. Date: Aug. 8, 1996

[30] Foreign Application Priority Data

Feb. 2, 1995 [DE] Germany ..... 195 03 324

[51] Int. Cl.[6] ..... H01B 17/38

[52] U.S. Cl. ..... 156/293; 174/176; 264/135; 264/262

[58] Field of Search ..... 156/293; 174/176; 264/135, 262

[56] References Cited

U.S. PATENT DOCUMENTS

| | | | |
|---|---|---|---|
| 3,576,938 | 5/1971 | Capotosto | 264/135 |
| 4,057,687 | 11/1977 | Willem | 174/179 |
| 4,267,402 | 5/1981 | Reighter | 174/206 |
| 4,316,054 | 2/1982 | Willem | 174/179 |
| 4,435,615 | 3/1984 | Kaczerginski | 174/179 |

FOREIGN PATENT DOCUMENTS

| | | |
|---|---|---|
| 615259 | 9/1994 | European Pat. Off. . |
| 2499301 | 8/1982 | France . |
| 4212146 | 8/1993 | Germany . |
| 95/26560 | 10/1995 | WIPO . |

*Primary Examiner*—Daniel Stemmer
*Attorney, Agent, or Firm*—Foley & Lardner

[57] ABSTRACT

The invention relates to an electrical isolator having at least one fitting cemented onto an insulating body, in which the insulating body is bonded to the fitting via a cement shell, wherein a laminated layer which contains at least two layers of different materials is applied on the fitting between the cement shell and the fitting, wherein at least one of the layers protects the fitting from corrosion and wherein at least one other layer permits movement between the cement shell and the fitting.

17 Claims, 1 Drawing Sheet

INSULATOR WITH CEMENT COMPOUND AND METHOD FOR ITS PRODUCTION

Figure 1:
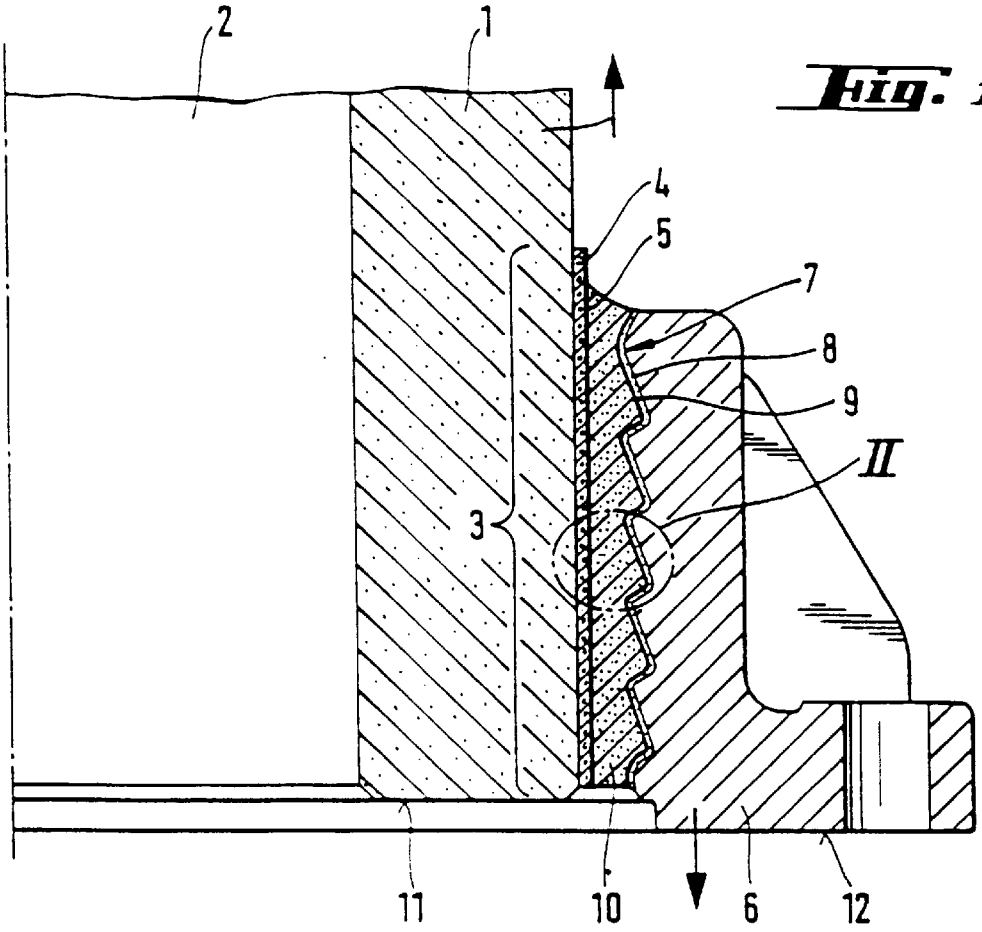

The invention relates to an electrical insulator having at least one fitting cemented onto an insulating body. Large numbers of insulators and, in particular, high-voltage insulators are used in overhead power transmission lines and outdoor switchgear. Most insulators consist of an insulating body having fittings, in the form of metal caps, fitted forcibly and/or positively on the ends of the insulating body. These fittings are primarily used for force transmission. The external diameter of the insulating body core and, in the case of hollow insulators, also the thickness of the insulating body core are primarily designed in accordance with the mechanical loading of the insulator. According to the magnitude and type of mechanical loading, the core ends and fittings are designed differently. The insulating bodies and the associated fittings are customarily designed essentially with rotational symmetry.

The core ends of long-rod insulators, which are mostly subjected to tensile forces, are usually designed conically. In order to produce the required forcible and/or positive connection between the insulating body and the fitting, the gap between the insulating body core and the fitting is usually filled with a lead alloy.

Post and/or hollow insulators have predominantly cylindrical core ends. Such core ends are frequently covered at the mounting position with round or crushed grit which is sintered in a glazing coat; this improves the forcible and/or positive fitting, as does ribbing, corrugation or rough surfaces in the region of the mounting position. The gap between the fitting and the core end is usually filled with settable or curable cementing material such as, for example, cement mortar. In particular in the case of post and/or hollow insulators, the cylindrical, grit-covered core ends are frequently bonded with a lean Portland cement forcibly and/or with positive fit to a fitting that usually consists of galvanized cast iron or of an aluminum alloy.

It is known to protect the internal sides of the fittings from chemical attack by the Portland cement/mortar by using a bituminous coating. Water situated in the gap between the fitting and the core end can develop a pH value of approximately 12 to 13 by reaction with the cement/mortar, both during setting of the Portland cement/mortar and also when using the high-voltage insulators in a humid climate. In addition, embodiments are known in which a cured epoxy resin coat or a synthetic resin coating with embedded quartz sand grain is chosen instead of the bituminous coating.

The embodiments according to the prior art have, apart from an adhesive layer which is occasionally applied onto the fitting and is intended to improve adhesion of the subsequent coating, only a single layer between the fitting and the cement shell that contains set cementing material. This single layer may consist of a multiplicity of layers of the same material. It has been determined in trials that it is not possible with this single layer between the fitting and the cement shell according to the prior art to produce both high flexural strengths in failure tests and also a low residual fitting displacement after routine tests with flexural and/or internal-pressure loading. Either, as in the case of the bituminous coatings, high residual fitting displacements were achieved in routine tests according to EN 50062, and high flexural strengths in failure tests, or the residual fitting displacements were small, as in the case of epoxy resin or sand-containing synthetic resin coatings, with an increased susceptibility to flaking and a low flexural strength simultaneously resulting. Flaking means exfoliation of the insulating body at its ends, essentially perpendicularly to the longitudinal axis.

The residual fitting displacement is the displacement between the lower side of the fitting and the end face of the insulating body core that is still present one day after the routine testing and due to the previously applied routine test loading according to EN 50062, DIN VDE 0674, part 3, November 1992, relative to the position before the routine test loading. The fitting displacement takes place predominantly in the longitudinal direction of the insulator and also leads to tilting in the case of laterally acting forces. It can be connected with stretching of the circumference of the fittings. The position of the fitting: is measured by means of metering clockwork as the distance between the polished insulating body end face and a planar, positionally marked beam applied onto the fitting end face every 90° in the direction of the insulator longitudinal axis; the largest difference value determined on a fitting between assigned measured values before and after routine testing is used as the value for the residual fitting displacement. The higher the residual fitting displacement, and the higher the break-up of the cement shell because of the movements between the grit and the cement shell, then the larger the risk that a sealing system fitted onto the insulating body end face is not permanently gas-tight. Sealing defects must absolutely be avoided in the case of equipment insulators filled with $SF_6$ gas.

The failure test is one of the mechanical tests carried out more often, in which a hollow insulator is, in flexural testing according to EN 50062, DIN VDE 0674, part 3, November 1992, tested in a multistage test up to the maximum load-carrying capacity and therefore until breaking. Insulators which are not hollow insulators can be tested in a similar way according to IEC 168, 1988. In this case the insulator is firmly clamped at the base and pulled perpendicularly to its longitudinal axis at the opposite end. The term flexural strength means in this case the maximum loading that can be sustained.

The object of the invention is to propose an insulator with a cement compound which guarantees both a high flexural strength and a low residual fitting displacement. There is the further object of making the fabrication of such insulators as simple as possible.

This object is achieved according to the invention with an electrical insulator having at least one fitting cemented onto an insulating body, in which the insulating body is bonded to the fitting via a cement shell, wherein a laminated layer which contains at least two layers of different materials is applied on the fitting between the cement shell and the fitting, wherein at least one of the layers protects the fitting from corrosion and wherein at least one other layer permits movement between the cement shell and the fitting.

Preferably, two, three or four different layers are applied between the cement shell and the fitting. Each of these layers can be constructed from a plurality of levels of the same material. One of these layers can be an adhesion promotor layer which is applied directly onto the fitting and is intended to improve adhesion between the fitting and the second layer applied on the armature.

The insulating bodies can consist, amongst other things, of ceramic or glass according to IEC 672, 1980. The fittings customarily consist of galvanized cast iron or an aluminum alloy. The shapes of the fittings are specifically designed. They can have a sawtooth profile on the side facing the mounting position. The cement shell customarily consists of a set or cured cementing material.

The layer in the laminated layer, which faces the fitting and protects the fitting from corrosion, has a thickness of 5 to 1000 $\mu$m, preferably from 20 to 500 in particular from 80 to 200 $\mu$m. When mortars or cements are used, this layer consists of a layer, resistant to alkalis, preferably an anti-corrosion material that is resistant to alkalis, such as, for example, cast resin, reactive or synthetic resin coating, and particularly preferably of two-component epoxy resin. The anti-corrosion material is preferably sprayed on or spread on.

The low-friction layer of the laminated layer, which permits and takes up movement between the cement shell and the fitting, can preferably have a subordinate anti-corrosion function. It can be applied directly on the anti-corrosion layer. This layer can consist of a bitumen-containing coating material, of another low-friction coating material or of a lubricant such as, for example, lubricants based on molybdenum sulfide or graphite, metal lubricants, low-friction coatings, greases and/or oils. The material of this layer must be resistant to the cementing material, the cement shell of cementing material which is cured or set with water, and also to the greatest possible extent to the water possibly contained. It can be spread or sprayed onto the coated fitting. The thickness of this layer can be equal to 2 to 1000 μm, preferably 5 to 200 μm, in particular 10 to 80 μm.

In addition, the object is solved by a method for producing an electrical insulator having at least one fitting cemented onto an insulating body, in which the insulating body is bonded to the fitting via a cement shell, wherein the internal side of the fitting, facing the cement shell, is coated with at least one layer having the function of corrosion protection and a layer that permits movement between the cement shell and the fitting.

Above all, mortar and cement can be used as cementing material. Among mortars and cements, grouting which can be poured in simple fashion into the gap between the core end of the insulating body and the fitting is particularly easy to process and favorable because it sets quickly. In addition, grouting does not need to be shaken in, as does other mortar and cement.

It is possible to employ the multi-layer laminate between the fitting and the cement shell in the case of all known fitting and insulating body materials which are cemented by means of cement, mortar or similar cementing materials, and, if appropriate, with the addition of other substances. The insulators according to the invention, primarily high-voltage insulators, are suitable in particular as post and/or hollow insulators. Usually, the individual layers can be clearly discerned visually when the fitting is sawed off and the laminated layer is cut into.

It was surprising that the object was made possible by using only at least two layers with different material composition and with different properties of the layer materials, the layer facing the cement shell being necessary to permit controlled relative movement between the cement shell and the fitting, in order to take up the forces occurring in this case and to brace the cement shell in the fitting, so that it is simultaneously possible to obtain both a high flexural strength and also low residual fitting displacements as a result of a controlled sliding movement.

A layer consisting of bituminous coating material, applied between the sintered grit layer and the cement shell has only a small effect, or no effect, on the residual fitting displacement. This layer preferably has a bonding action and a damping action, with regard to the differential thermal expansion, in particular between the insulating body and the cement shell.

The invention is explained below by way of example with the aid of an exemplary embodiment:

FIG. 1 represents a longitudinal section through a hollow isolator in the region of the mounting position.

Figure 2:
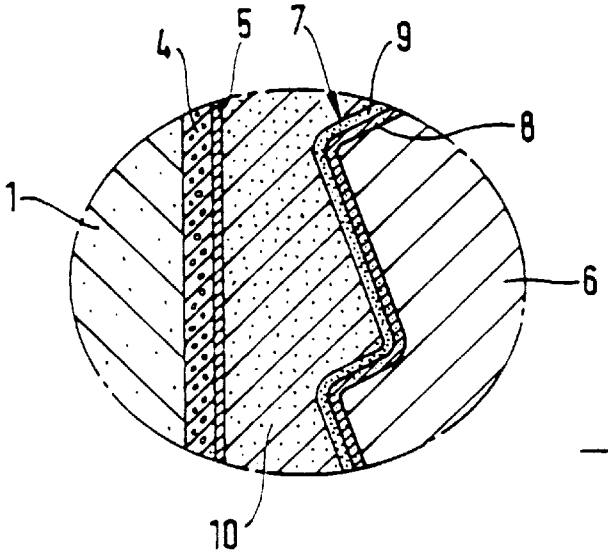

FIG. 2 reproduces the detail II in FIG. 1 on an enlarged scale.

The insulating body 1 has a longitudinally extending cylindrical hollow space 2 at its middle. In the region of the mounting position 3, grit 4, which can sintered with glazing and, if appropriate, can also have a layer 5 of bituminous coating material, is applied onto the surface of the insulating body 1. The fitting 6 has a sawtooth profile on the side facing the mounting position 3 and is covered with a laminated layer 7 consisting of two layers 8 and 9. The anti-corrosion layer 8 is covered with a low-friction layer 9 that permits and takes up movement between the fitting 6 and the cement shell 10. The gap between the insulating body 1 and the fitting 6 is primarily filled with set or cured cementing material that forms the cement shell 10. Under loading and for a limited period of time thereafter, a relative movement between the fitting and the cement shell takes place in the low-friction layer 9 under loading approximately in the direction of the arrow, and thereafter in approximately the opposite direction. The insulating body end face 11 is approximately parallel to the fitting end face 12.

Examples 1 and 2 as comparative examples and Examples 3 to 6 according to the invention are explained in more detail below:

A so-called ground insulator of average size, which is commonly used and which is intended for operation as a hollow insulator at 145 kV, was chosen for the tests. The insulating bodies of the test specimens consisted of alumina porcelain. The cylindrical core ends had, in the region of the mounting position, an external diameter of approximately 200 mm. Round grit which was sintered with glazing was applied thereon; a bituminous coating was applied on top of this. The fittings consisted of the aluminum alloy G-AlSi10 Mg wa and had an internal sawtooth profile. The fittings were completely coated on the inside with the materials specified in Table 1. The coatings were applied by spraying. Other parameters influencing the cementing were kept constant.

The structure of the layers and the results of the trials are reported in Tables 1 and 2. The layer thicknesses were in each case measured eight times over the circumference of the fitting and represent approximate values for the slightly fluctuating layer thickness.

Table 1: Structure of the layers. The layer thicknesses are average values over several trials. The layer thickness of the assembly spray was not determined.

| Example | Anti-corrosion layer | Mobile layer |
|---|---|---|
| CE 1 | 99 μm bituminous coating | none |
| CE 2 | 162 μm epoxy resin | none |
| E3 | 114 μm epoxy resin | assembly spray |
| E4 | 140 μm epoxy resin | 28 μm bituminous coating |
| E5 | 144 μm epoxy resin | 13 μm bituminous coating |
| E6 | 137 μm epoxy resin | 58 μm bituminous coating |

One day before the failure test, the following routine tests were carried out: first a flexural test to 70% of the rated bending moment on in each case 3 test specimens produced in the same way, and subsequently an internal pressure test with a holding time of one minute according to EN 50062 up to approximately 70% of the minimum burst pressure. In the case of the flexural tests, the upper and lower ends were tested separately; the force was applied to the cylindrical porcelain body outside the fitting. In the flexural test, the test specimens were loaded for 10 s, in each case shifted through 90°. In the subsequent visual inspection, damage due to the routine testing was not established on any of the test specimens. On the day of the failure test, the residual fitting displacement caused by the flexural test and the internal pressure test was determined.

The failure test was carried out with the same alignment of the insulator relative to the test apparatus as in the fourth load cycle of the flexural test. Loading was carried out until failure of the hollow insulators due to bending. In each test, the three insulators were in each case broken at the top and at the bottom. In this case 8 wire strain gauges were fitted, perpendicularly to the longitudinal direction of the insulator, on the outwardly projecting fitting edge of each fitting, in order to determine the fitting extensions. The values of the flexural strength were determined from 6 measured values in each case.

TABLE 2

| Test results | | | | |
|---|---|---|---|---|
| | Residual fitting | Flexural strength average minimum | | Fitting extension |
| Example | displacement mm | kNm | kNm | μm/m |
| CE 1 | 0.152 | 41.55 | 36.00 | 542 |
| CE 2 | 0.019 | 34.02 | 20.70 | 292 |
| E 3 | 0.052 | 43.05 | 30.00 | 513 |
| E 4 | 0.007 | 37.60 | 29.30 | 488 |
| E 5 | 0.032 | 48.40 | 43.70 | not determined |
| E 6 | 0.015 | 46.70 | 43.50 | not determined |

As the test results reproduced in Table 1 show, sufficiently high flexural strengths and low residual fitting displacements were achieved in the examples according to the invention compared to the comparative examples. Compared to the variant with epoxy resin coating (CE 2), it was possible to increase the measured value of the lowest respective flexural strength by approximately 50%. The residual fitting displacement is close to the fitting displacement of the variant with epoxy resin coating (CE 2), which is to be categorized as very low.

The measured values for the fitting extension, which were measured in the failure tests according to EN 50062 with a rated bending moment of 20 kNm, confirm that, as is similarly known for shrinkage compounds, high radial stresses give high flexural strengths. The high extension values measured are based on a relative movement between the cement shell and the fitting, in which the fitting is pulled essentially in the longitudinal direction of the insulator out of the cement shell away from the insulating body; in this case, with a sawtooth profile of the fitting and of the cement shell, the fitting is diametrically extended. The mobile layer is decisive for the high fitting extension under loading of the cement compound. This results in a high radial stress acting on the cement shell, resulting in high strength values. Further, when the load on the cement shell is removed at the end of each mechanical test, controlled sliding of the fitting backward, and thereby a low residual fitting displacement are achieved.

We claim:

1. A method for producing an electrical insulator having at least one fitting cemented onto an insulating body, comprising: bonding the insulating body to the at least one fitting via a cement shell, and coating the internal side of the fitting, facing the cement shell, with at least two layers of different materials, wherein at least one of the layers protects the fitting from corrosion and at least one other layer permits movement between the cement shell and the fitting.

2. The method for producing an electrical insulator as claimed in claim 1, wherein the layer having the function of corrosion protection has a thickness of 5 to 1000 μm.

3. The method for producing an electrical insulator as claimed in claim 1, wherein the layer that permits movement between the cement shell and the fitting has a thickness of 2 to 1000 μm.

4. The method for producing an electrical insulator as claimed in claim 1, wherein three or four layers of different materials are applied on the fitting.

5. The method for producing an electrical insulator as claimed in claim 1, wherein one of at least three layers is an adhesive layer applied on the fitting.

6. The method for producing an electrical insulator as claimed in claim 1, wherein a grit layer on which a layer of bituminous coating material is applied onto the insulating body in the region of a mounting position.

7. The method for producing an electrical insulator as claimed in claim 1, wherein the layer having the function of corrosion protection contains a cast resin or a reactive or synthetic resin coating.

8. The method for producing an electrical insulator as claimed in claim 1, wherein the layer that permits movement between the cement shell and the fitting contains a coating material or a lubricant.

9. The method for producing an electrical insulator as claimed in claim 8, wherein the layer that permits movement between the cement shell and the fitting comprises a bitumen-containing coating material, or a lubricant selected from the group consisting of molybdenum sulfide, graphite, metal lubricants, greases, and oils.

10. The method for producing an electrical insulator as claimed in claim 1, wherein the material for the layer having the function of corrosion protection is spread or sprayed onto the fitting or onto an adhesion promotor layer applied onto the fitting.

11. The method for producing an electrical insulator as claimed in claim 1, wherein the layer that permits movement between the cement shell and the fitting is spread or sprayed onto the fitting.

12. The method for producing an electrical insulator as claimed in claim 1, wherein as cementing material, grouting is poured into a gap between the insulating body and the fitting and sets therein.

13. A method for producing an electrical insulator having at least one fitting cemented onto an insulating body, comprising bonding the insulating body to at least one fitting via a cement shell, and coating the internal side of the fitting, facing the cement shell, with at least two layers, wherein at least one of the layers protects the fitting from corrosion and comprises a cast resin, a reactive resin, or a synthetic resin coating, and at least one layer permits movement between the cement shell and the fitting and comprises bitumen or a lubricant selected from the group consisting of molybdenum sulfide, graphite, metal lubricant, grease, and oil.

14. The method for producing an electrical insulator having at least one fitting cemented onto an insulating body as claimed in claim 13, wherein the layer that permits movement between the shell and the fitting has a thickness of 2 to 200 μm.

15. The method for producing an electrical insulator having at least one fitting cemented onto an insulating body as claimed in claim 13, wherein the layer that permits movement between the shell and the fitting has a thickness of 2 to 80 μm.

16. The method according to claim 13, wherein the layer that protects the fitting rrosion comprises an epoxy resin.

17. The method according to claim 13, wherein the layer that permits movement the cement shell and the fitting comprises bitumen.

* * * * *